US011057710B2

(12) United States Patent
Cinanni

(10) Patent No.: US 11,057,710 B2
(45) Date of Patent: Jul. 6, 2021

(54) LOUDSPEAKER STRUCTURE

(71) Applicant: ASK INDUSTRIES SOCIETA' PER AZIONI, Monte San Vito (IT)

(72) Inventor: Dario Cinanni, Senigallia (IT)

( * ) Notice: Subject to any disclaimer, the term of this patent is extended or adjusted under 35 U.S.C. 154(b) by 0 days.

(21) Appl. No.: 16/619,773

(22) PCT Filed: Jun. 7, 2018

(86) PCT No.: PCT/EP2018/065085
§ 371 (c)(1),
(2) Date: Dec. 5, 2019

(87) PCT Pub. No.: WO2018/224616
PCT Pub. Date: Dec. 13, 2018

(65) Prior Publication Data

US 2020/0137498 A1 Apr. 30, 2020

(30) Foreign Application Priority Data

Jun. 9, 2017 (IT) ..... 102017000064097

(51) Int. Cl.

| | |
|---|---|
| ***H04R 11/00*** | (2006.01) |
| ***H04R 9/06*** | (2006.01) |
| ***H04R 7/26*** | (2006.01) |
| ***H04R 9/02*** | (2006.01) |
| ***H04R 9/04*** | (2006.01) |

(52) U.S. Cl.
CPC ..... *H04R 9/06* (2013.01); *H04R 7/26* (2013.01); *H04R 9/027* (2013.01); *H04R 9/045* (2013.01); *H04R 2207/021* (2013.01)

(58) Field of Classification Search
CPC . H04R 1/24; H04R 17/00; H04R 1/22; G10K 11/16
USPC ..... 381/337, 345, 117, 412
See application file for complete search history.

(56) References Cited

U.S. PATENT DOCUMENTS

| | | | | |
|---|---|---|---|---|
| 3,074,504 | A | 1/1963 | Trautman | |
| 8,695,753 | B2 | 4/2014 | Goossens et al. | |
| 2016/0373863 | A1* | 12/2016 | Song | H04R 7/20 |

FOREIGN PATENT DOCUMENTS

| | | | |
|---|---|---|---|
| EP | 2663092 | A2 | 11/2013 |
| JP | 2008042618 | A | 2/2008 |
| JP | 2010062828 | A | 3/2010 |
| KR | 20070104044 | A | 10/2007 |
| WO | 0223946 | A2 | 3/2002 |
| WO | 2005101899 | A2 | 10/2005 |

OTHER PUBLICATIONS

International Search Report for Corresponding PCT/EP208/065085.
Written Opinion of the ISA for Corresponding PCT/EP208/065085.
IPRP for Corresponding PCT/EP208/065085.

* cited by examiner

*Primary Examiner* — George C Monikang
(74) *Attorney, Agent, or Firm* — Egbert, McDaniel & Swartz, PLLC

(57) ABSTRACT

A loudspeaker having: a magnetic unit, a voice coil axially movable in the air gap of the magnetic unit, a basket fixed to the magnetic unit, a membrane fixed to the cylindrical support of the voice coil and connected to the basket, and a vibrating element fixed to said membrane by means of a rim. The vibrating element has a base fixed to the membrane, a shank that projects from the base and a mass that projects from the shank in cantilever mode.

13 Claims, 12 Drawing Sheets

LOUDSPEAKER STRUCTURE

The present patent application for industrial invention relates to a structure of membrane loudspeaker, in particular for controlling the vibration modes of the loudspeaker membrane.

Various types of membrane loudspeakers are known. This type of loudspeakers have problems related with the vibrations of the membrane, especially at medium and high frequencies, which impair the quality of the sound emitted by the loudspeaker.

In the prior art the problems related with the vibrations of the membrane are solved by adding masses in various points of the membrane.

WO2005/101899 discloses a membrane loudspeaker wherein masses shaped as a circular or elliptical rings are peripherally disposed on the surface of the membrane of the loudspeaker.

EP2663092 discloses a membrane loudspeaker wherein a single central mass with disc-like shape is disposed under the membrane.

U.S. Pat. No. 8,695,753 discloses a membrane loudspeaker wherein a plurality of disc-like masses is disposed on the membrane of the loudspeaker, along circular lines with concentric rings, in an alternate, non-continuous way.

The aforementioned prior documents relate to a specific mass distribution on the surface of the loudspeaker membrane in order to reduce the amount of the vibration modes of the membrane. However, such prior solutions are exclusively based on the weight and on the arrangement of the masses in order to suppress undesired vibrations. Consequently, the total weight of the membrane to be vibrated is considerably increased because of the addition of the masses and therefore a less efficient loudspeaker with a lower performance than the same loudspeaker without masses is obtained.

The prior documents do not contain any teachings on how to reduce the weight of these masses, while effectively controlling the vibration.

JP2008042618 discloses a solution to increment the radiant surface of a loudspeaker membrane without having to increase the width of the loudspeaker. Such a solution provides for a central shank disposed on the main membrane and connected to a structure of membranes (diaphragms) that project in cantilever mode from said shank. Such a shank is used to transmit the vibration from the main membrane to the other membranes that are consistently moved with the main membrane. All membranes move together and the total mass of the loudspeaker membrane is equal to the sum of the masses of all membranes. Such a structure is equal to a loudspeaker with a single membrane, but with a larger emitting surface.

It must be considered that a loudspeaker membrane is a deformable element that must vibrate and has a very low density (approximately 170 kg/m$^3$), which is considerably lower than a mass of a rigid non-deformable vibrating element with a high density (approximately 900 Kg/m$^3$). Therefore, the membranes used in JP2008042618 are not suitable for generating a vibrating element. On the contrary, the function of these membranes is to vibrate while emitting a sound. Therefore, an expert of the field who wants to solve the problem of controlling the vibrations on the main membrane of a loudspeaker would not think about using a system like the one of JP2008042618, which provides for a plurality of vibrating membranes connected to a shank. In fact, such a system would make it more difficult to control the vibrations in the vibrating membranes that project in cantilever mode from the shank.

Moreover, the solution disclosed in JP2008042618 can be suitable for low frequencies, which only have a piston motion of the main membrane, but not suitable for high frequencies, which have different vibration modes of the main membrane that are transmitted to the other membranes and cannot be controlled.

JP2010062828 discloses a magnetic suspension connected to the loudspeaker membrane, which is suitable for keeping the voice coil centered in the air gap, exactly like the mechanical suspensions consisting in centering devices, spiders, or edges that are normally used in all loudspeakers. Obviously, such a magnetic suspension must be disposed in a peripheral position of the membrane or, in any case, in a peripheral position relative to the voice coil. Furthermore, it must be considered that in order to control the vibration of a loudspeaker, the mass connected to the membrane must be free to oscillate in all directions, otherwise no vibration control would be obtained. The document JP2010062828 discloses a projecting mass composed of a magnet connected to the membrane disposed between two magnets that generate a guiding magnetic field, and therefore the magnet connected to the membrane is constrained to an exclusively vertical motion. Therefore, the magnet connected to the membrane is not free to oscillate in all directions and cannot control the vibration of the membrane.

KR20070104044 does not disclose a membrane loudspeaker. Such a document discloses a piezoelectric or piezoceramic vibrator, wherein the control of the vibration is obtained by a piezoelectric transducer and no mass is necessary to control the vibration. Such a piezoelectric transducer has no membrane and operates as a shaker that needs to be put in contact with a rigid vibrating surface in order to emit the sound. A suction cap is applied on the vibrator for fastening to a desk whereon the vibrations are transmitted. The suction cap is a soft, deformable material with a very low density, approximately 200 Kg/m$^3$ and cannot be used as rigid non-deformable mass for vibration control.

U.S. Pat. No. 3,074,504 Discloses a Loudspeaker with a Parallelepiped Weight Arranged on the Diaphragm.

The purpose of the present invention is to reduce the drawbacks of the prior art by providing a loudspeaker structure able to control the membrane vibration modes at medium and high frequencies, minimizing the mass to be applied on the membrane and consequently maximizing the efficiency and the performance of the loudspeaker.

Another purpose of the invention is to increment the performance of the elements inserted on the membrane of the loudspeaker, converting them into objects that can actively interact with the membrane, at different frequencies, depending on the geometry of the elements, regardless of their total mass.

These purposes are achieved according to the invention with the characteristics of the independent claim 1.

Advantageous embodiments of the invention appear from the dependent claims.

The loudspeaker of the invention comprises:

- a magnetic unit wherein an air gap is generated,
- a voice coil mounted on a cylindrical support and disposed in such manner as to move axially in the air gap of the magnetic unit,
- a basket fixed to the magnetic unit,
- a membrane fixed to the cylindrical support of the voice coil and connected to the basket, a rim connected to a peripheral part of the membrane and to the basket, and at least one vibrating element fixed to said membrane.

The vibrating element comprises:

a base fixed to said membrane, a shank that projects from the base, and a mass that projects from the shank in cantilever mode.

The mass is of rigid non-deformable material and is free to oscillate in any direction.

Because of such a geometrical configuration of the vibration element, wherein the mass projects in cantilever mode from the shank, the vibration of the membrane can be controlled at medium and high frequencies, while minimizing the weight of the vibrating element and maximizing the acoustic efficiency and the acoustic performance of the loudspeaker.

Additional features of the invention will appear evident from the detailed description below, which refers to merely illustrative, not limiting embodiments, wherein.

Figure 1:
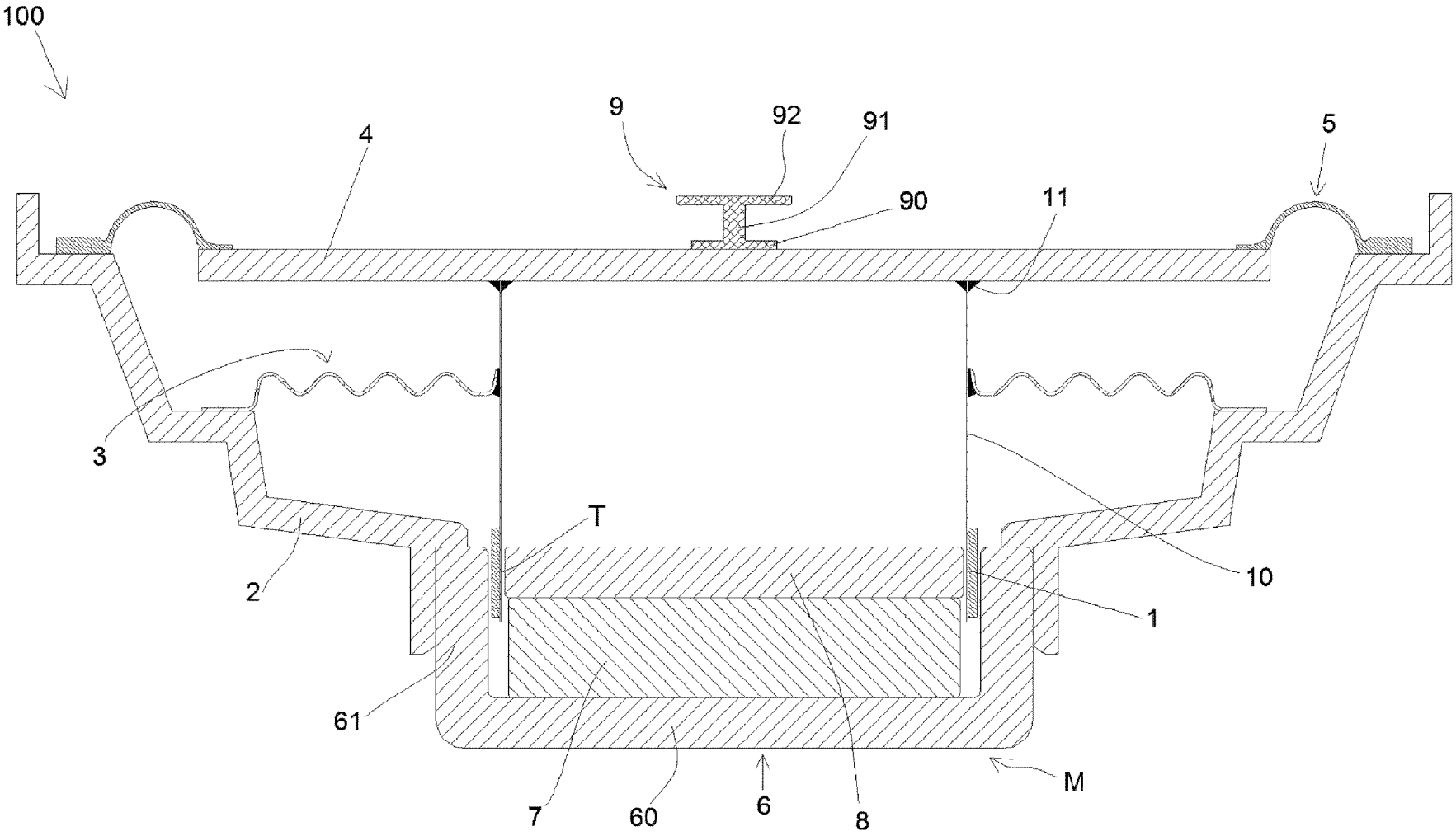
FIG. 1 is an axial sectional view of a first embodiment of a loudspeaker structure according to the invention.

With reference to the Figures, the loudspeaker of the invention is disclosed, which is generally indicated with reference numeral (100).

With reference to FIG. 1, a loudspeaker (100) comprises a magnetic assembly (M) wherein an air gap (T) is generated.

A voice coil (1) is mounted on a cylindrical support (10) and is disposed with possibility of axial movement in the air gap (T) of the magnetic assembly. The voice coil (1) shown in the drawing has only one winding, but can have multiple windings. A basket (2) is fixed to the magnetic assembly (M).

A centering device (3) is fixed to the basket (2) and to the cylindrical support (10) of the voice coil, in such way as to maintain the voice coil (1) in the air gap (T) of the magnetic assembly. The centering device (3) comprises at least one elastic suspension. The centering device (3) is optional and may not be provided, for example in tweeter loudspeakers.

A membrane (4) is fixed to the cylindrical support (10) of the voice coil. The membrane (4) is of flat type, but it could also be a non-flat membrane, for example with a cone or dome shape. The flat membrane may have a honeycomb structure disposed between two layers of paper, or it may be made of carbon fiber, Kevlar fiber (a para-amid based substance), aluminum or Nomex (a meta-aramid substance). The membrane (4) is deformable and has a density of 170 $Kg/m^3$.

The membrane (4) is fixed to a rim of the cylindrical support (10), in a distal position relative to the voice coil (1), by means of welding or gluing (11). For illustrative purposes, the membrane (4) has a circular shape with a diameter that is almost double than the diameter of the cylindrical support (10).

A rim (5) is connected to the basket (2) and to a peripheral part of the membrane (4). The rim (5) comprises an elastic suspension.

When the voice coil (1), which is immersed in a radial magnetic field, is crossed by the electrical current, according to the Lorentz law, a force is generated, which causes the axial displacement of the cylindrical support (10) of the voice coil, causing the movement and the vibration of the membrane (4) that generates a sound. Therefore the loudspeaker (100) produces the sound by means of the displacement of the membrane (4).

For illustrative purposes, the magnetic unit (M) may comprise a lower polar plate (6) with cup shape, having a base (60) and a lateral wall (61). A magnet (7) is disposed on the base (60) of the lower polar plate and an upper polar plate (8) is disposed on the magnet. In view of the above, the air gap (T) is defined as a toroidal air gap between the lateral surface of the upper polar plate (8) and the lateral surface (61) of the lower polar plate.

Although this type of magnetic unit is shown in the Figures, evidently, an equivalent magnetic unit can be used, such as a magnetic unit provided with a polar plate with a central core (T-Joke) and a toroidal magnet disposed around the core of the polar plate. Moreover, a magnetic unit with multiple air gaps with multi-winding coil can be used.

According to the invention, at least one vibrating element (9) is disposed in the membrane (4). Advantageously, the at least one vibrating element (9) is disposed in an area of the surface of the membrane (4) with the highest displacement value at a set frequency, in relation to the vibration modes of the membrane.

In the example of FIG. 1, the vibrating element (9) is disposed in a central part of the membrane (4).

The vibrating element (9) comprises a base (90), a shank (91) that projects from the base and a mass (92) that projects from the shank (91) in cantilever mode.

The base (90) is used for fixing to the membrane (4). The base minimally affects the frequency response of the membrane. Therefore the base (90) must be as small as possible in order not to increase the total weight of the membrane. The base (20) may be shaped as a disc-like plate.

The function of the shank (91) is to support the mass (92) in cantilever mode. However, the length of the shank (91) affects the frequency response of the membrane because it displaces the center of gravity of the mass (92). Therefore, the length of the shank (91) is selected according to the frequency response to be obtained, i.e. according to the vibrations of the membrane (4) to be controlled.

The mass (92) affects the frequency response of the membrane, not according to its weight, but according to the projection from the shank (91). Therefore, the dimensions of the mass are chosen according to the frequency response to be obtained.

The mass (92) is a rigid, non-deformable element in order not to generate additional vibrations.

The mass (92) must be free to oscillate in all directions. In fact, the mass (92) is activated by a vertical movement of the membrane (4), but its dissipation function is performed with a horizontal (oscillation) movement.

The mass (92) is made of a different material from the membrane and has a higher specific weight than the membrane (4). Advantageously, the mass (92) is made of hard plastic, for example ABS, and has a density of 900 $Kg/m^3$.

Advantageously, the mass (92) has a disc-like shape with the smallest thickness possible in order not to increase its weight. The thickness of the mass (92) can be approximately 0.5-1.5 mm.

The diameter or maximum width of the mass (92) is approximately 1/12-1/8 of the diameter of the membrane (4).

The vibrating element (9) can be made of plastic material in one piece, for example by injection molding.

The shank (91) is disposed in a central position relative to the base (90) and to the mass (91). In such a case, the vibrating element (9) has a substantially "H"-shaped cross-section. The mass (92) has a higher diameter than the base (90).

Following are some comparative examples of a traditional loudspeaker with a honeycomb flat membrane disposed between two layers of paper, having a thickness of 2 mm and a diameter of 100 mm, and a loudspeaker according to the invention, wherein a vibrating element is applied in the central part of the membrane.

Figure 2:
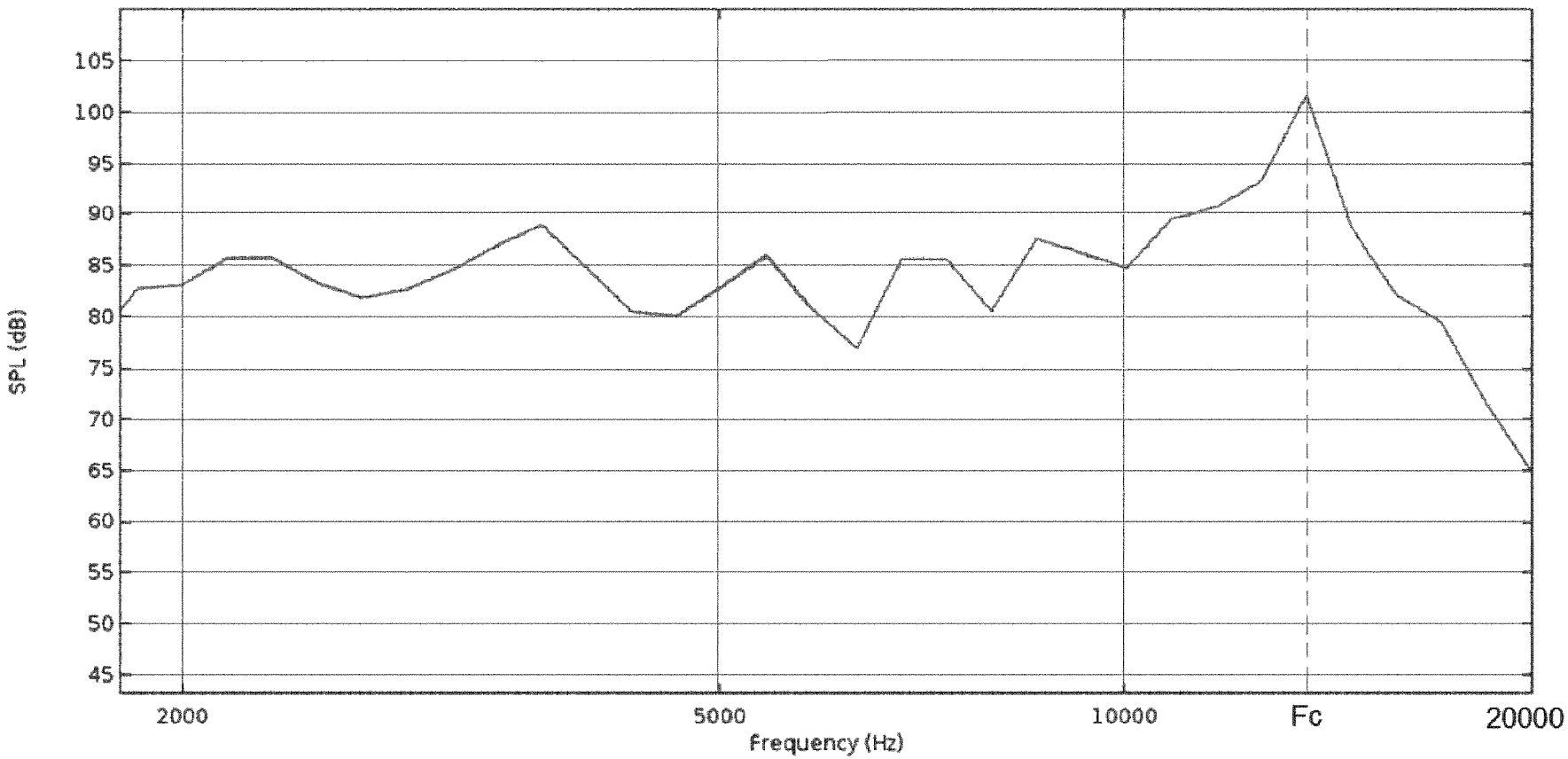
FIG. 2 is a chart that shows the sound pressure level (SPL) according to the frequency in a FEA (Finite Element Analysis) simulation performed on a loudspeaker without vibrating element, wherein a virtual microphone is disposed along the axis of the loudspeaker, at a distance of 1 meter from the loudspeaker.

FIG. 2 shows the results of a FEA simulation in case of a loudspeaker without vibrating element, which shows the sound pressure level (SPL) according to the frequency. As shown in the chart of FIG. 2, a peak of SPL is obtained for a frequency (fc) of approximately 13 kHz. Instead, the SPL drops dramatically for frequencies higher than 13 kHz. According to these results, the dimensions of the vibrating element (9) are selected in such a way as to operate at the frequency (fc) of approximately 15 kHz in order to attenuate the peak of the SPL and avoid a reduction of the SPL at higher frequencies.

Figure 3:
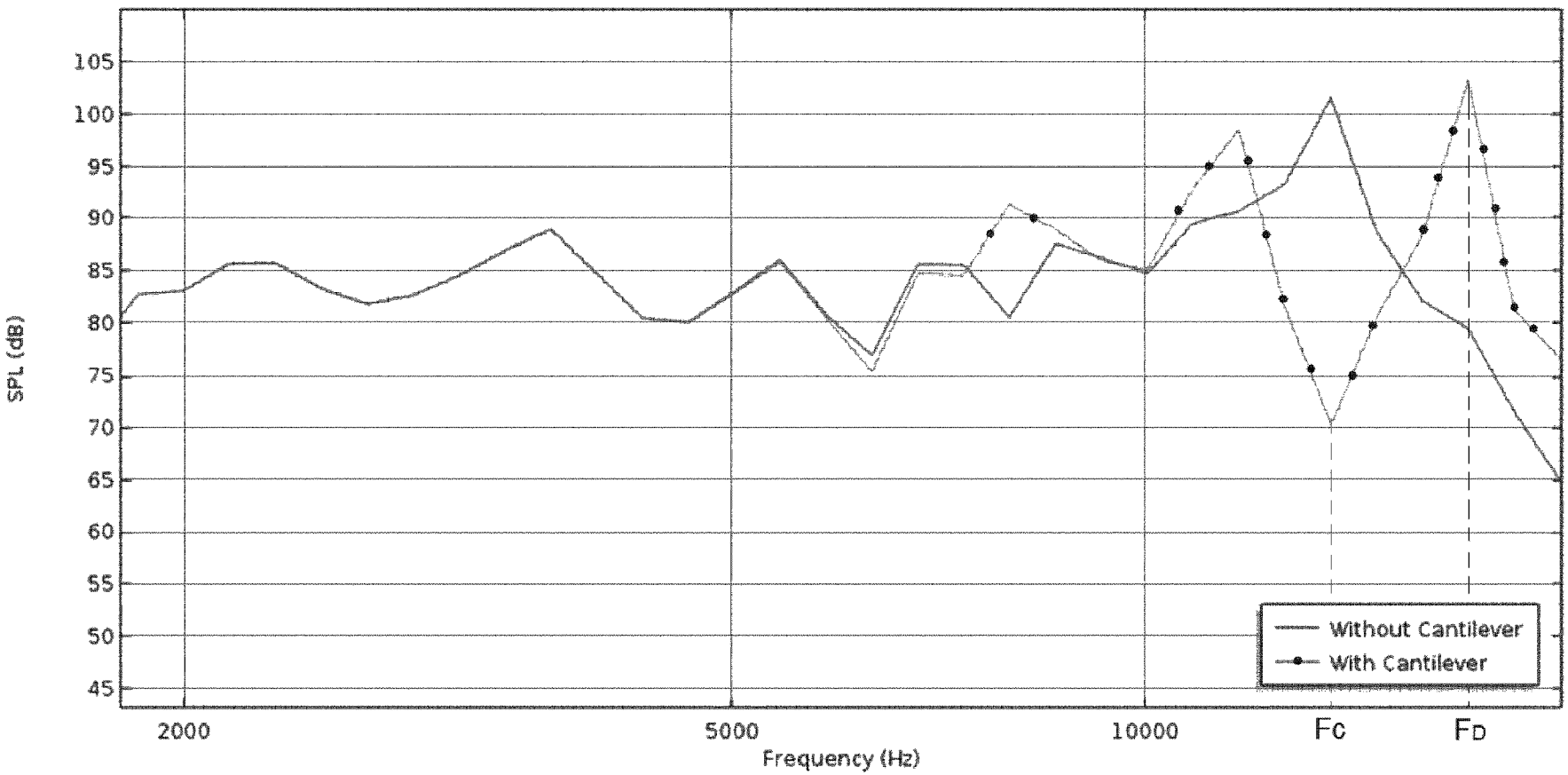
FIG. 3 is a chart like FIG. 2, which also shows the results of a FEA simulation performed on a loudspeaker with vibrating element according to the invention.

With reference to FIG. 3, the results of the simulation with vibrating element (9) have been overlapped to the results of the FEA simulation without vibrating element. As shown in the chart, with the vibrating element, a minimum value is obtained at the frequency fc of approximately 13 kHz because the vibrating element (9) contributes to absorb the vibration of the membrane at said frequency. Instead, a peak of the SPL is obtained at a frequency FD of approximately 17 kHz, which covers the reduction of the SPL obtained without the vibrating element.

Moreover, FEA simulations were performed on the physical deformation and the stress of the membrane, without and with the vibrating element.

Figure 4:
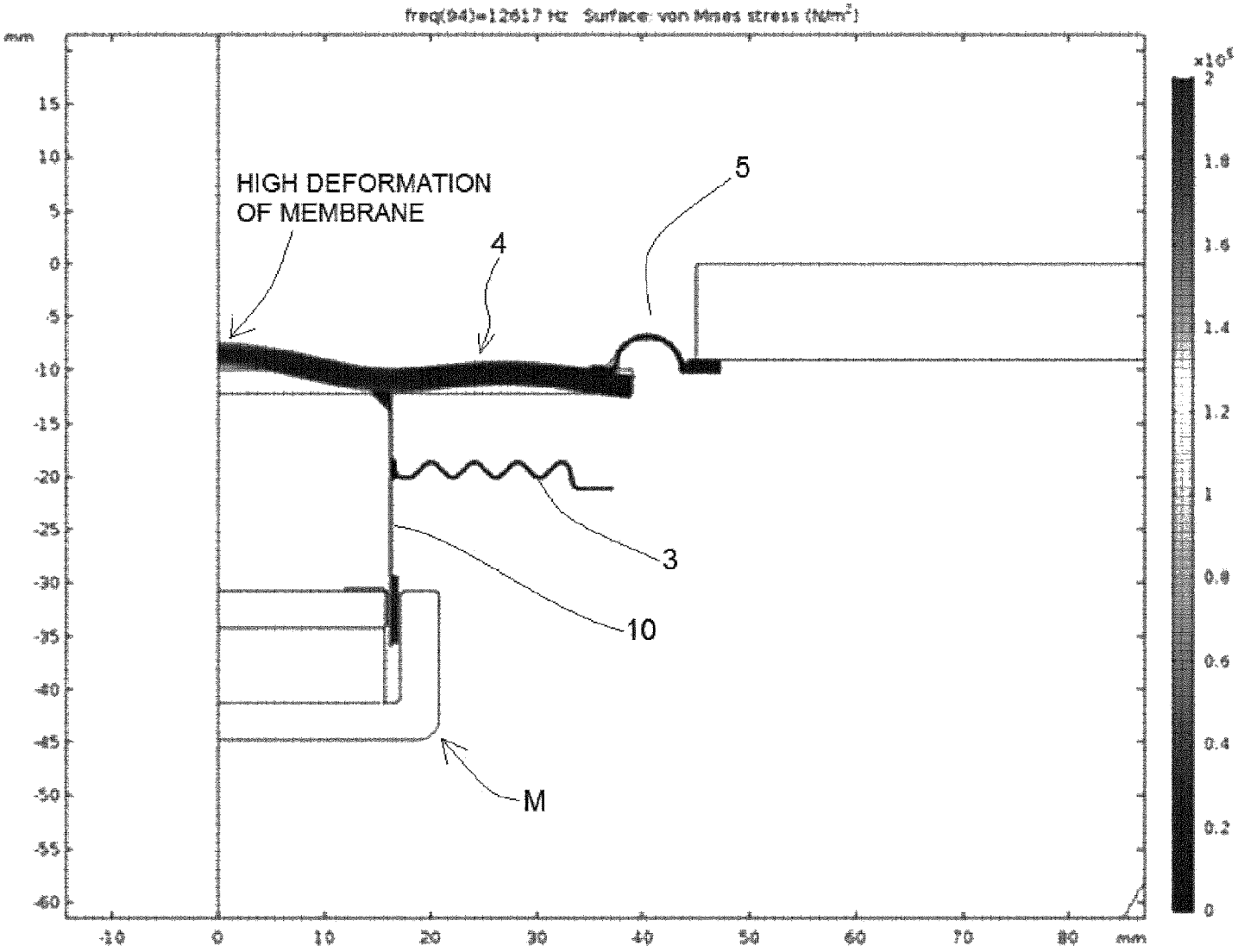
FIGS. 4 and 5 are two diagrammatic drawings that show FEA simulations of the deformation of the membrane at a frequency of approximately 13 kHz in a loudspeaker without vibrating element and in a loudspeaker with vibrating element.

With reference to FIG. 4, at a frequency of approximately 13 kHz, the membrane without the vibrating element suffers a high deformation in its central part. For this reason, it was decided to dispose the vibrating element in the central part of the membrane.

Figure 5:
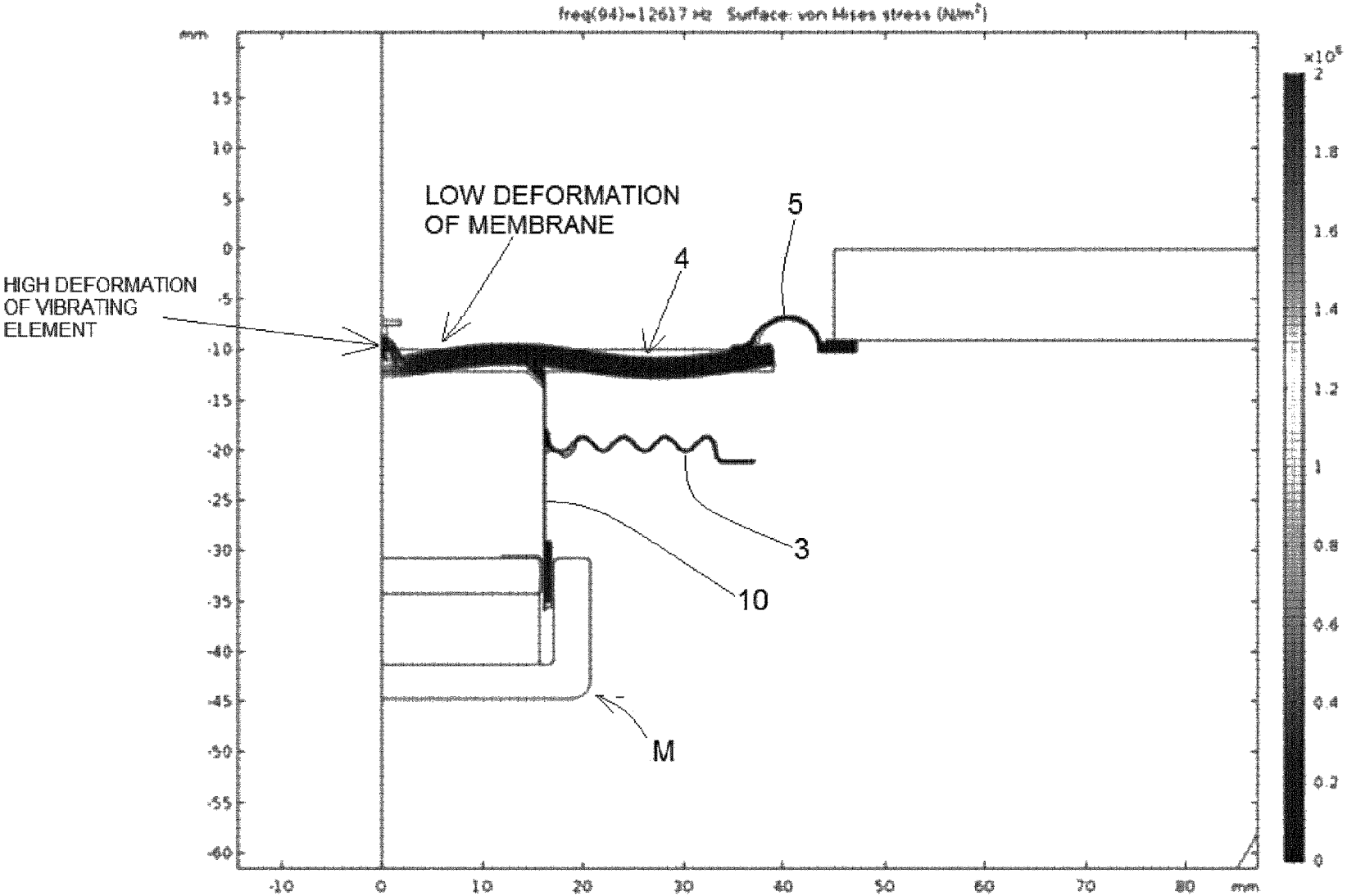

Instead, with reference to FIG. 5, at a frequency of approximately 13 kHz, the membrane with the vibrating element suffers a low deformation in its central part, whereas the vibrating element suffers the maximum deformation.

Furthermore, simulations of the SPL were performed at given frequencies on the surface around the loudspeaker, along a transverse section plane.

Figure 6:
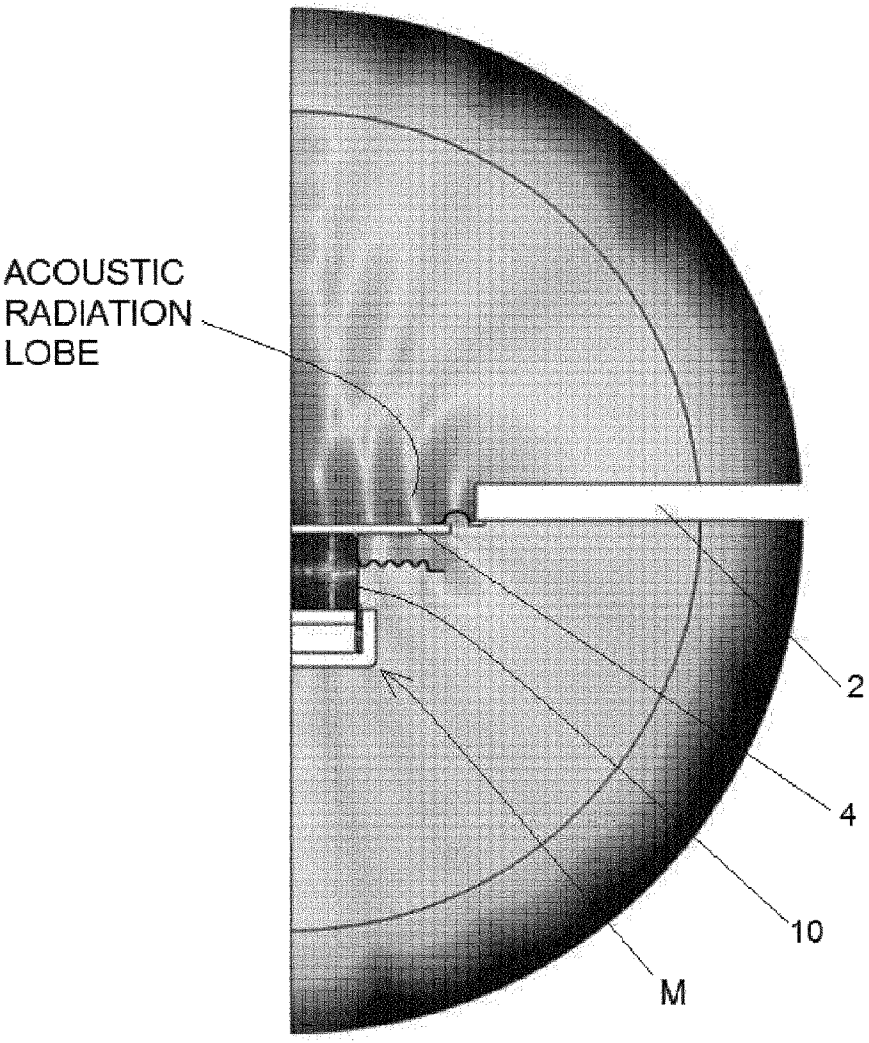

With reference to FIG. 6, radiation lobes, which are shown as light-colored bands, are evident in the case of a loudspeaker without vibrating element, at a frequency of 15 kHz. The lobes demonstrate that the behavior of the loudspeaker without vibrating element is not optimal at the frequency of 15 KHz. Consequently, according to the distance from the loudspeaker and to the inclination relative to the axis of the loudspeaker, there will be areas with a different sound pressure level that are fragmented in proportion to the radiation lobes.

Figure 7:
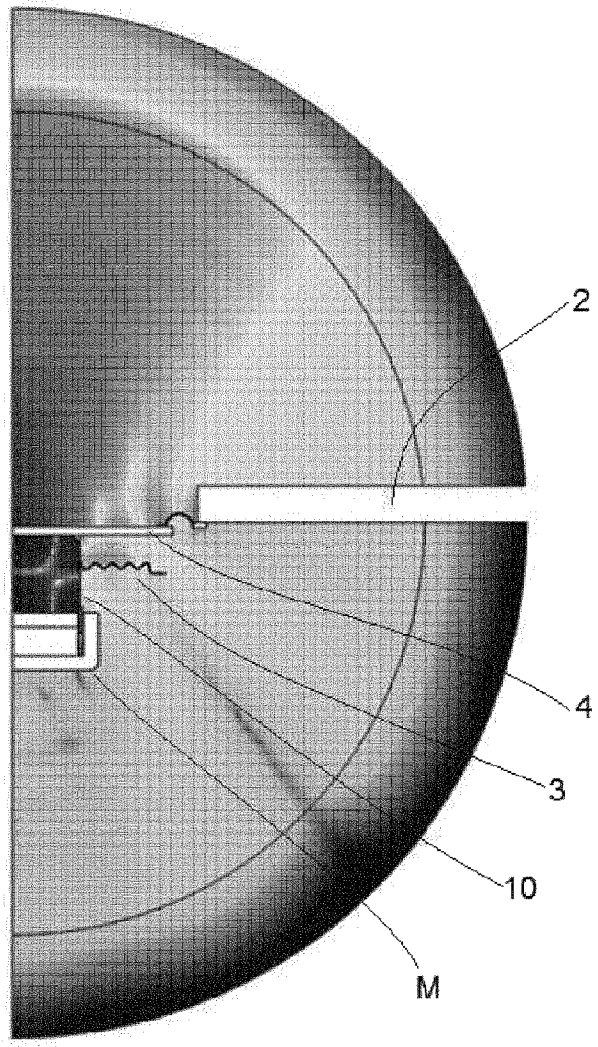
FIGS. 6 and 7 are two diagrammatic drawings, which show FEA visual simulations of the SPL at a frequency of 15 kHz in a loudspeaker without vibrating element and in a loudspeaker with vibrating element.

Instead, as shown in FIG. 7, in the case of a loudspeaker with vibrating element, the radiation lobes disappear almost completely. The dark-colored part above the membrane (4) indicates a good sound diffusion, which is substantially uniform in all the areas covered by the loudspeaker.

The dimensions of the vibrating element (9) were selected according to the FEA simulations. In such a specific case, for example, the shank (91) was selected with a height of approximately 2-3 mm and the mass (92) with a diameter of approximately 6-10 mm. Otherwise said, the diameter of the mass (92) is lower than 1/10 of the diameter of the membrane. The total weight of the vibrating element (9) is 0.05 g; considering the sum of the weights of the membrane (4) and of the rim (5), which is 5 g, the vibrating element accounts for 1% of the weight of the membrane (4) and of the rim (5). The constructional tolerance on the weight of the membrane (4) and of the rim (5) is approximately 5%. Therefore, the vibrating element has a weight that is lower than 5% of the weight of the membrane (4), i.e. lower than the constructional tolerance of the membrane.

The vibrating element (9) was physically built and applied on the central part of the membrane (4). In order to ensure that the results of the simulations were correct, experimental tests were performed to make real measurements of the SPL of the loudspeaker without the vibrating element, and of the SPL of the loudspeaker with the vibrating element, by placing a microphone at a distance of 1 meter from the loudspeaker, in aligned position relative to the axis of the loudspeaker.

Figure 8:
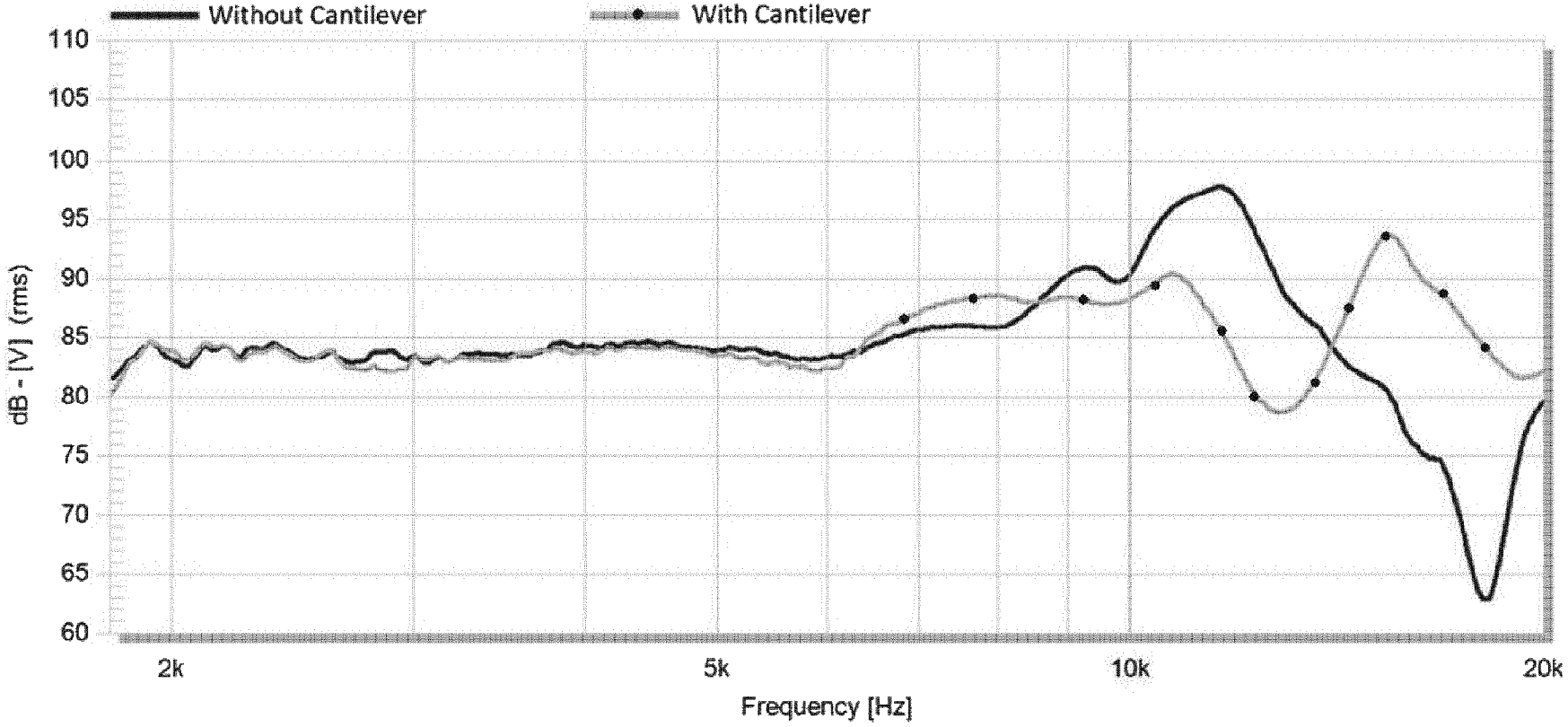
FIG. 8 is a chart that shows the SPL according to the frequency in experimental tests performed on a loudspeaker without vibrating element and in a loudspeaker with vibrating element, with a microphone disposed along the axis of the loudspeaker at a distance of 1 meter from the loudspeaker.

As clearly shown in FIG. 8, the experimental tests gave the same results as the simulation, i.e. a better frequency response and a more uniform SPL are obtained with the vibrating element (9), with a better performance at high frequencies.

Figure 9:
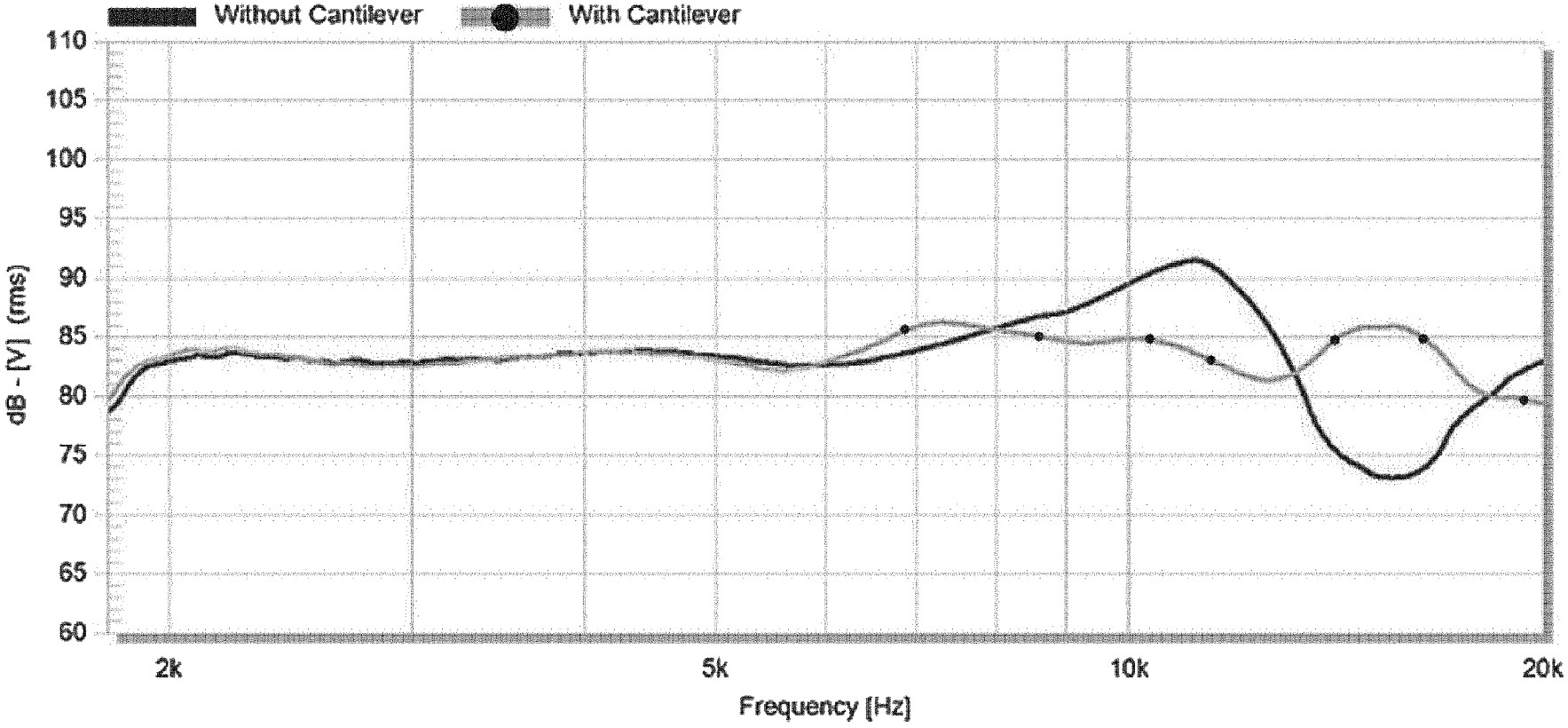
FIGS. 9 and 10 are the same charts as FIG. 8, except for the fact that they show experimental tests performed with a microphone disposed on an axis inclined by 15° relative to the axis of the loudspeaker and on an axis inclined by 30° relative to the axis of the loudspeaker at a distance of 1 meter from the loudspeaker.
Figure 10:
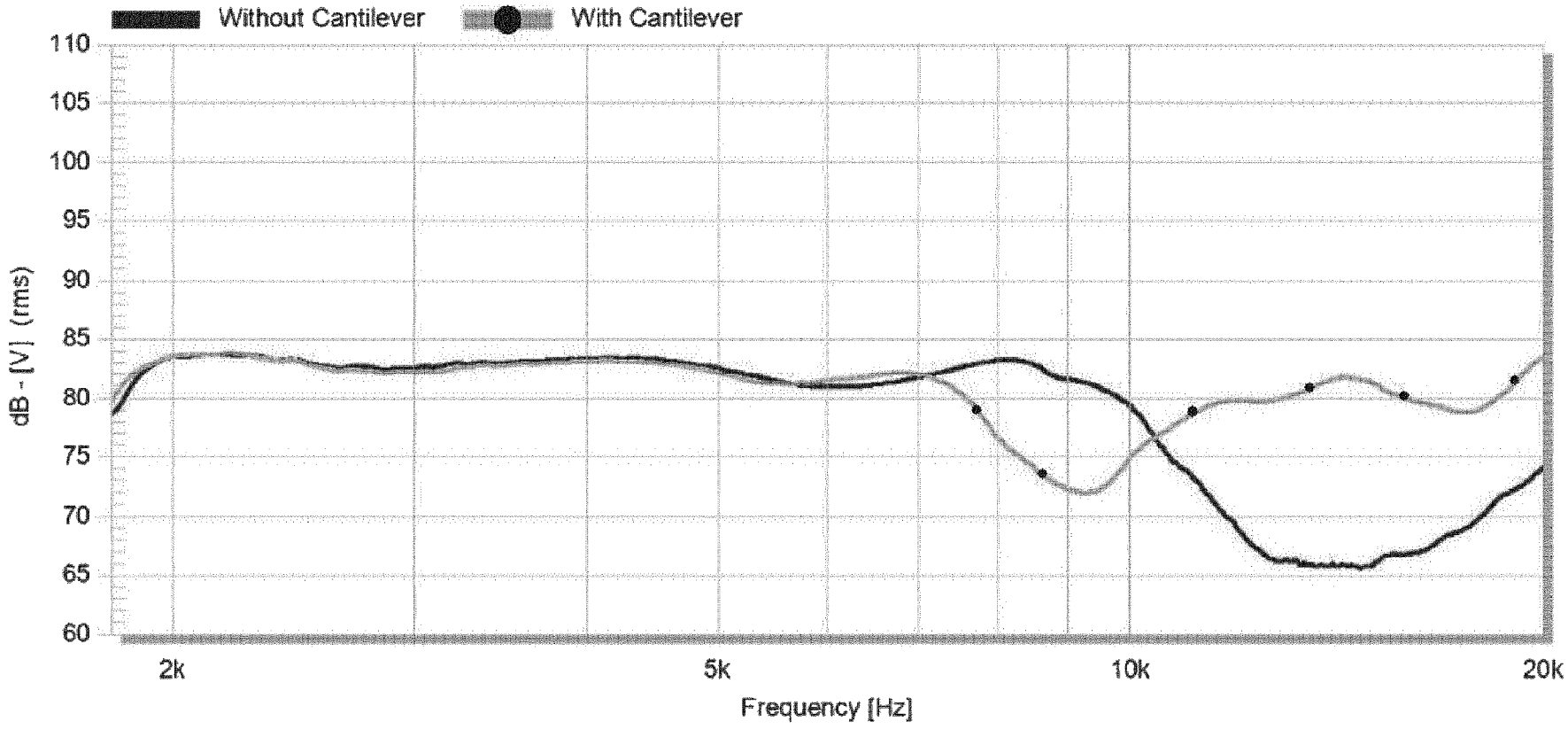

The experimental tests were repeated by placing the microphone on a straight line inclined by 15° relative to the axis of the loudspeaker (see FIG. 9) and by placing the microphone on a straight line inclined by 30° relative to the axis of the loudspeaker (see FIG. 10).

As shown in the charts of FIGS. 9 and 10, the solution with the vibrating element (9) gives better results also when the microphone is disposed in off-axis position relative to the axis of the loudspeaker.

Figure 11:
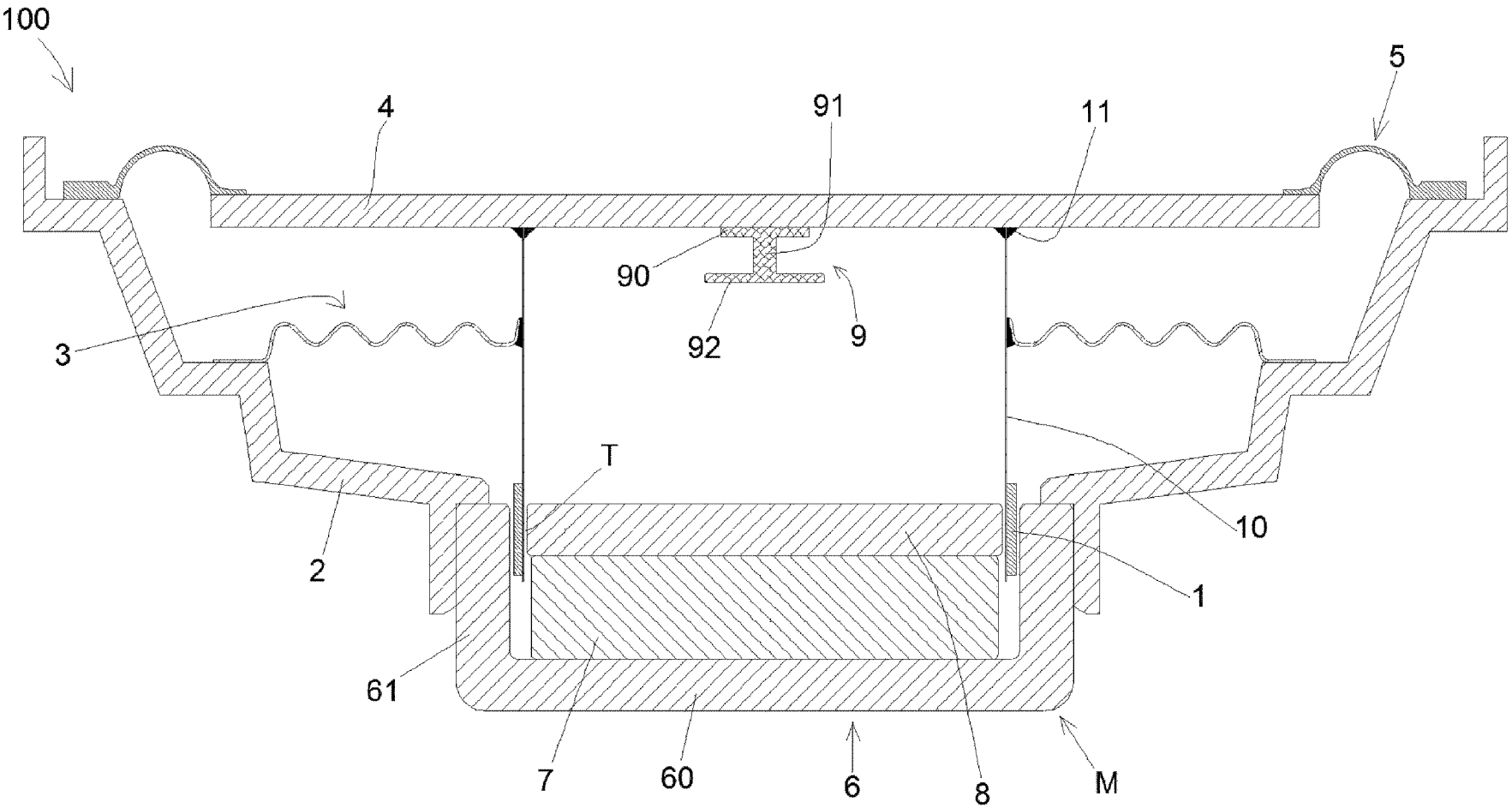
FIGS. 11 and 12 are the same views as FIG. 1, which show variants of the loudspeaker according to the invention.

FIG. 11 shows a variant, wherein the vibrating element (9) is disposed under the membrane (4) in a central part of the membrane; otherwise said, the mass (92) of the vibrating element faces the magnetic unit (M).

Figure 12:
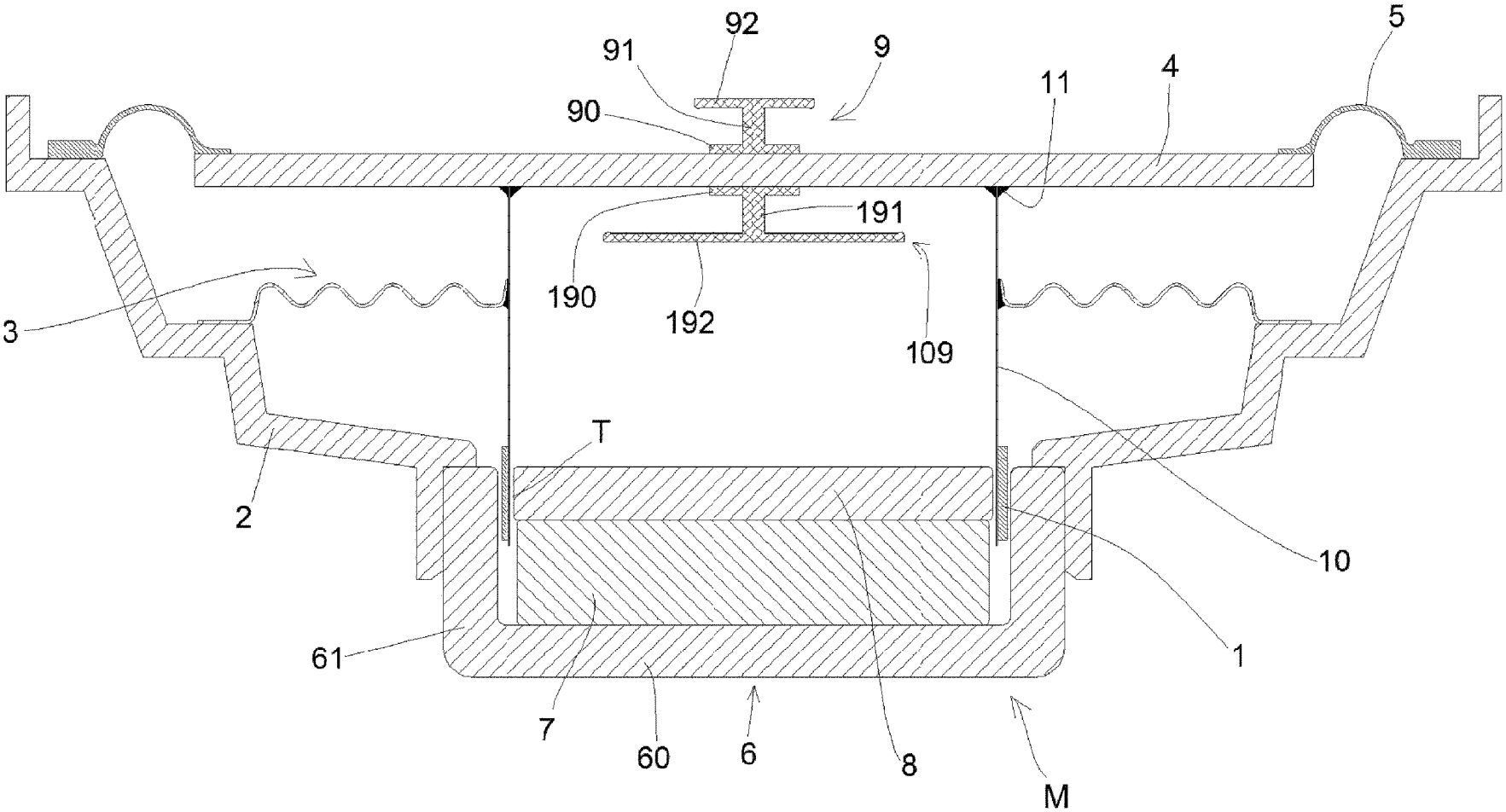

FIG. 12 shows an additional variant, wherein the loudspeaker comprises a first vibrating element (9) disposed above the membrane (4) and a second vibrating element (109) disposed under the membrane. The structure of the second vibrating element (109) is substantially similar to the one of the first vibrating element (9). The second vibrating element (109) comprises a base (190), a shank (191) that projects from the base and a mass (192) that projects from the shank (91) in cantilever mode.

The shanks (91, 191) of the two vibrating elements are disposed in axial position relative to the axis of the membrane (4).

In this case, the base (190) and the shank (191) of the second vibrating element have the same dimensions as the base (90) and the shank (91) of the first vibrating element. Instead, the mass (192) of the second vibrating element has a larger diameter than the diameter of the mass (92) of the first vibrating element. For example, the mass (192) of the second vibrating element has a diameter that is approximately 2-3 times the diameter of the mass (92) of the first vibrating element. Such a solution allows to tune two vibrating elements (9; 109) at two different frequencies.

Figure 13:
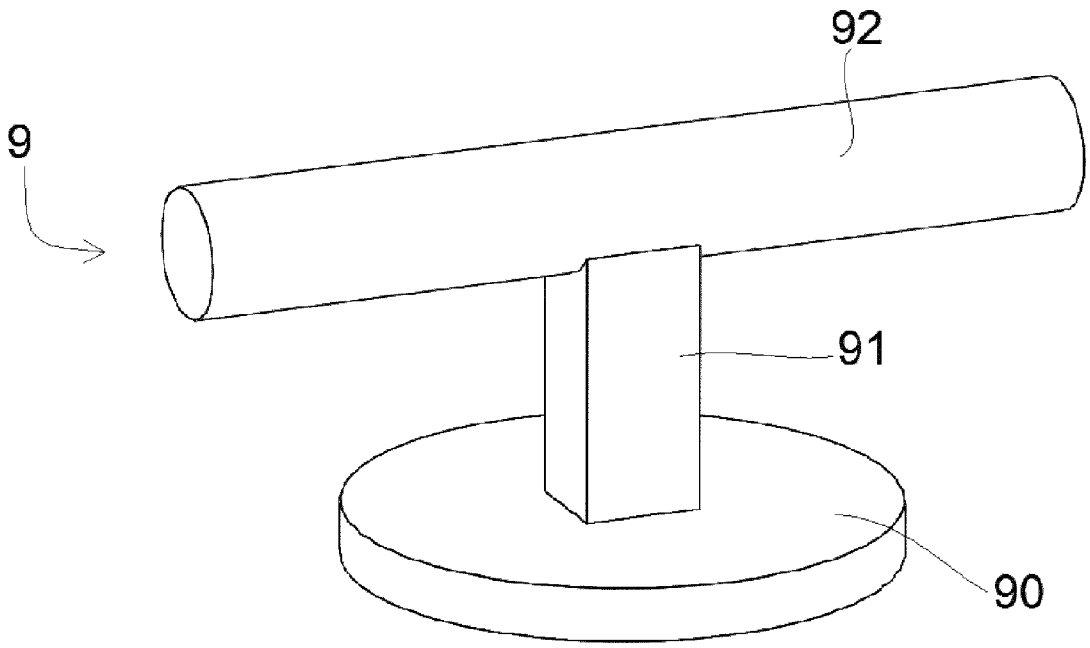
FIGS. 13 and 14 are two perspective views that show two variants of the vibrating element.

FIG. 13 shows a first variant of the vibrating element, wherein the shank (91) has a parallelepiped structure and the mass (92) has a cylindrical structure with orthogonal axis relative to the axis of the shank (91).

Figure 14:
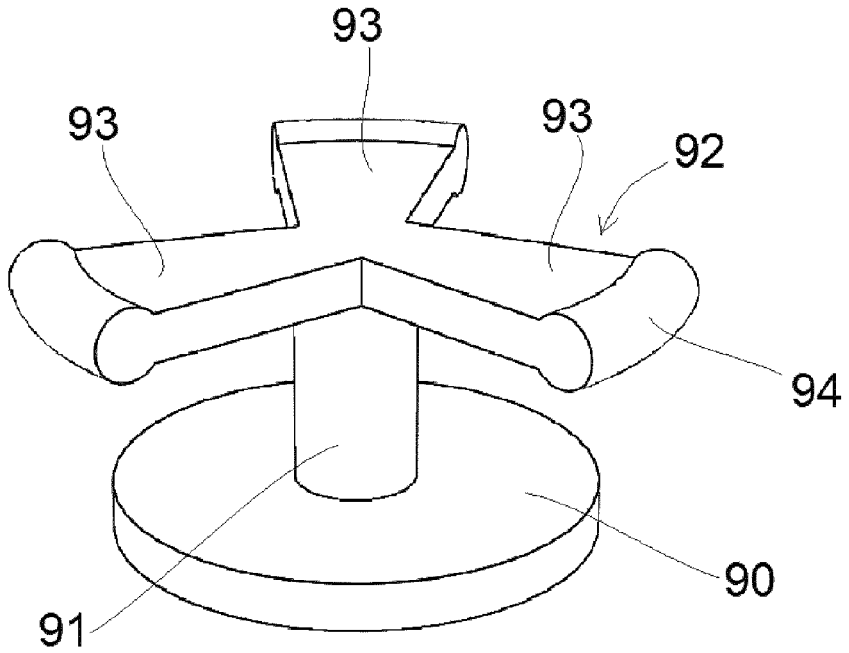

FIG. 14 shows a second variant of the vibrating element, wherein the mass (92) comprises a plurality of tabs (93) that protrude radially from the shank (91). For illustrative purposes, the mass (92) comprises three tabs (93) that are equally spaced angularly. Each tab (93) has a rounded ending edge (94) with higher diameter than the thickness of the tab.

Numerous equivalent variations and modifications can be made to the present embodiments of the invention, which are within the reach of an expert of the field, falling in any case within the scope of the invention.

The invention claimed is:

1. A loudspeaker comprising:

a magnetic unit having an air gap therein;

a voice coil mounted on a cylindrical support and disposed so as to move axially in the air gap of said magnetic unit;

a basket fixed to said magnetic unit;

a membrane fixed to the cylindrical support of said voice coil and connected to said basket;

a rim connecting a peripheral part of said membrane to said basket; and at least one vibrating element configured to control vibrating modes of said membrane, said at least one vibrating element being fixed to said membrane, said at least one vibrating element comprising:

a base fixed to said membrane;

a shank that projects from said base; and a mass that projects from said shank in a cantilever and manner, wherein said mass is of a rigid non-deformable material, said mass being free to oscillate in any direction, wherein said at least one vibrating element is made of an injection molded plastic material.

2. The loudspeaker of claim 1, wherein said at least one vibrating element is made formed of a single piece of plastic material.

3. The loudspeaker of claim 1, wherein said mass is of a hard plastic material.

4. The loudspeaker of claim 1, wherein said at least one vibrating element is disposed in an area of a surface of said membrane with a highest displacement value at a set frequency in relation to vibration modes of said membrane.

5. The loudspeaker of claim 4, wherein said at least one vibrating element is disposed in a central portion of said membrane.

6. The loudspeaker of claim 1, wherein said mass of said at least one vibrating element has a discoidal shape.

7. The loudspeaker of claim 6, wherein said shank of said at least one vibrating element has a cylindrical shape and is disposed in an axial position with respect to said mass.

8. The loudspeaker of claim 6, wherein said base of said at least one vibrating element has a discoidal shape with a diameter less than a diameter of said mass.

9. The loudspeaker of claim 1, wherein said mass of said at least one vibrating element has a diameter less than 1/10 of a diameter of said membrane.

10. The loudspeaker of claim 1, wherein said at least one vibrating element has a weight less than 5% of a weight of said membrane and of said rim.

11. The loudspeaker of claim 1, wherein said at least one vibrating element is disposed above said membrane such that said mass faces toward an exterior of the loudspeaker.

12. The loudspeaker of claim 1, wherein said at least one vibrating element is disposed under said membrane with said mass facing toward said magnetic unit.

13. The loudspeaker of claim 1, said at least one vibrating element comprising;

a first vibrating element disposed above said membrane; and a second vibrating element disposed under said membrane.

* * * * *